US008313166B2

(12) United States Patent
Pan

(10) Patent No.: US 8,313,166 B2
(45) Date of Patent: Nov. 20, 2012

(54) CLEANING DEVICE FOR INK WIPER

(75) Inventor: Tien-Yu Pan, Taipei (TW)

(73) Assignee: Kinpo Electronics, Inc., New Taipei (TW)

( * ) Notice: Subject to any disclaimer, the term of this patent is extended or adjusted under 35 U.S.C. 154(b) by 511 days.

(21) Appl. No.: 12/213,407

(22) Filed: Jun. 19, 2008

(65) Prior Publication Data

US 2009/0273630 A1 Nov. 5, 2009

(30) Foreign Application Priority Data

May 2, 2008 (TW) ..... 97116340 A

(51) Int. Cl.
*B41J 2/165* (2006.01)

(52) U.S. Cl. ..... 347/33

(58) Field of Classification Search ..... 347/33
See application file for complete search history.

(56) References Cited

U.S. PATENT DOCUMENTS

| | | | | |
|---|---|---|---|---|
| 5,440,331 A | | 8/1995 | Grange | |
| 5,606,354 A | * | 2/1997 | Bekki et al. | 347/33 |
| 6,151,044 A | * | 11/2000 | Gaasch | 347/33 |
| 6,168,257 B1 | | 1/2001 | Aldrich | |
| 2002/0105560 A1 | * | 8/2002 | Shimizu et al. | 347/33 |
| 2005/0146554 A1 | * | 7/2005 | Asanuma et al. | 347/33 |
| 2005/0225593 A1 | * | 10/2005 | Ito et al. | 347/33 |

FOREIGN PATENT DOCUMENTS

| | | | |
|---|---|---|---|
| JP | 2-113949 | | 4/1990 |
| JP | 5-92576 | | 4/1993 |
| JP | 07017045 A | * | 1/1995 |
| JP | 2003-63021 | | 3/2003 |

* cited by examiner

*Primary Examiner* — Shelby Fidler
(74) *Attorney, Agent, or Firm* — Jianq Chyun IP Office

(57) ABSTRACT

A cleaning device for ink wiper is disclosed. The cleaning device is arranged in a position adjacent to the ink wiper. The cleaning device includes a stand and an ink-absorbing unit disposed on the stand. The ink-absorbing unit is constantly in contact with at least one face of the wiper. In the reciprocation travel of the wiper, the ink-absorbing unit serves to clean off the ink stagnating on the wiper. Therefore, the wiper is prevented from being stained with the ink so as not to affect the ink-wiping effect of the wiper.

6 Claims, 5 Drawing Sheets

CLEANING DEVICE FOR INK WIPER

BACKGROUND OF THE INVENTION

The present invention relates generally to a cleaning device for ink wiper, and more particularly to a cleaning device mounted in an office machine such as an ink jet printer for cleaning the ink wiper. When the ink wiper is reciprocally moved, the cleaning device cleans off the ink remaining on the ink wiper.

A conventional ink jet printer has a printing head arranged in a position above a paper-delivering path by a set height. The printing head is reciprocally movable in a direction normal to the paper-delivering path. The printing head serves to jet ink onto papers to form characters or pictures.

In general, the printing head includes multiple nozzles for jetting ink. When the nozzles repeatedly jet ink onto a paper, some ink drops will stagnate around the nozzles and eventually become solid sediments. The solid sediments will partially clog the nozzles to change the ink-jetting direction. This will affect the printing quality.

Various types of cleaning devices have been developed for solving the problem of stagnation of ink drops around the nozzles. For example, Japanese Patent Nos. JP2003-63021, JP2-113949 and JP5-92576 respectively disclose cleaning devices including brush and wiper mechanisms drivable by rotational driving units. The brush and wiper mechanisms serve to pass through lower sides of the nozzles and once or twice back and forth wipe up the nozzles from the stagnant ink drops.

U.S. Pat. Nos. 6,168,257 B1 and 5,440,331 disclose otherwise designed cleaning devices. The cleaning device includes a bracket and a slide rack on which a wiper is mounted. The bracket has an inclined rail. The slide rack is slidable along the rail between different positions at different heights. When the slide rack slides along the rail, the wiper wipes off the ink drops stagnating on the nozzles.

The slide rack has a projecting pin slidably positioned in the rail. When the printing head moves toward the wiper, the slide rack is pushed and the projecting pin is moved along the rail to another position at another height. Simultaneously, the slide rack and the wiper are moved to another position at another height to wipe off the ink drops stagnating on the nozzles or cap the nozzles of the printing head.

When the wiper wipes off the ink drops stagnating on the nozzles, the ink will flow along the wiper into an ink-collecting case under the wiper. However, some ink will remain on the wiper and eventually dry and solidify. This will affect the ink-wiping effect provided by the wiper.

It is therefore tried by the applicant to provide a cleaning device for the wiper. No additional driving unit (such as motor) is needed for driving the cleaning device. When the wiper moves, the cleaning device cleans off the ink stagnating on the wiper. Therefore, the wiper is prevented from being stained with the ink so as to minimize the deterioration of the ink-wiping effect of the wiper.

SUMMARY OF THE INVENTION

It is therefore a primary object of the present invention to provide a cleaning device for ink wiper. The cleaning device is arranged in a position adjacent to the ink wiper. The cleaning device includes a stand and an ink-absorbing unit disposed on the stand. The ink-absorbing unit is constantly in contact with at least one face of the wiper. In the reciprocation travel of the wiper, the ink-absorbing unit serves to clean off the ink stagnating on the wiper. Therefore, the wiper is prevented from being stained with the ink so as not to affect the ink-wiping effect of the wiper.

It is a further object of the present invention to provide the above cleaning device in which the stand is arranged on a carrier having a guide channel. The stand has a leg section slidably fitted in the guide channel, whereby the stand and the ink-absorbing unit are movable along the guide channel along with the wiper.

It is still a further object of the present invention to provide the above cleaning device in which the ink-absorbing unit is made of a spongy material or the like. When the wiper is vertically reciprocally moved, the ink-absorbing unit absorbs the ink remaining on the wiper.

The present invention can be best understood through the following description and accompanying drawings wherein:

DETAILED DESCRIPTION OF THE PREFERRED EMBODIMENTS

Figure 1:
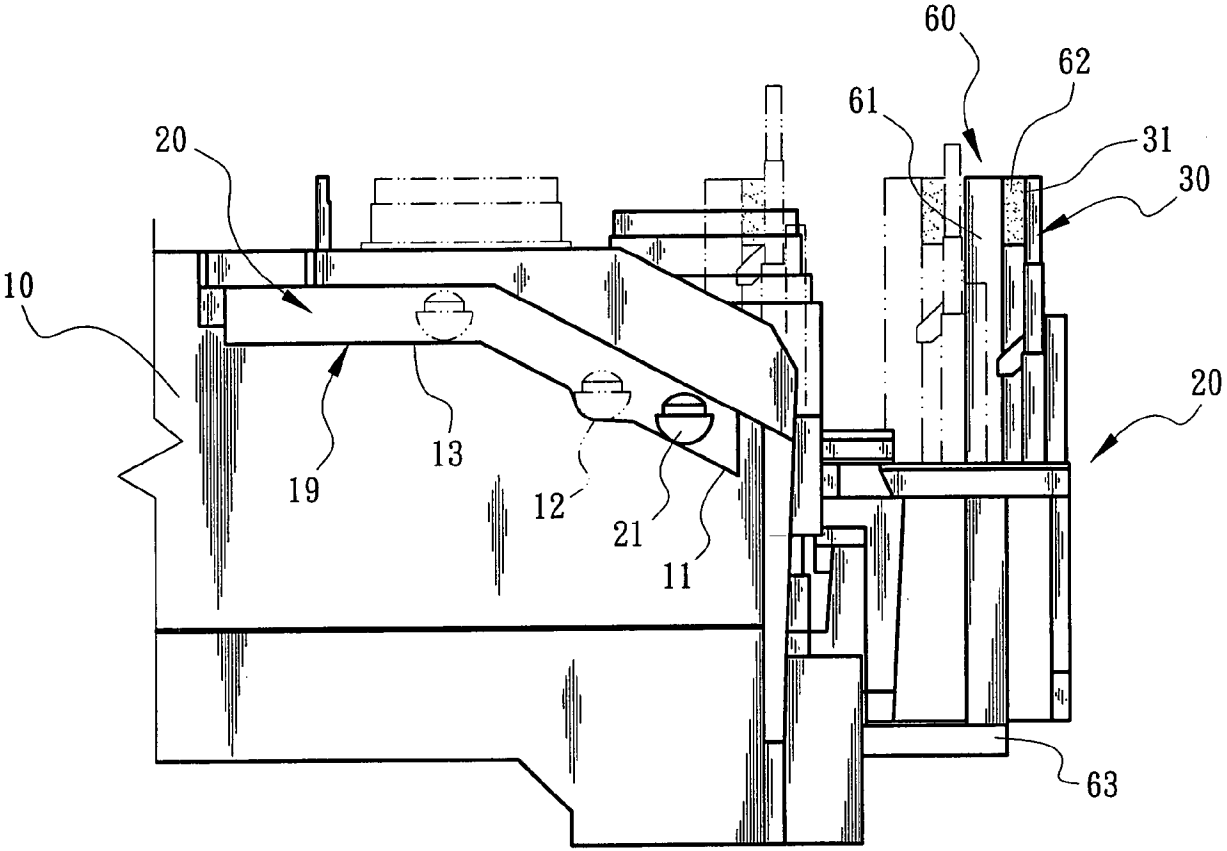
FIG. 1 is a side view of the cleaning device for ink wiper of the present invention, showing that the ink-absorbing unit of the cleaning device is arranged in contact with the wiper, in which the phantom lines show that the slide rack is movable between the first position, the second position and the third position.
Figure 2:
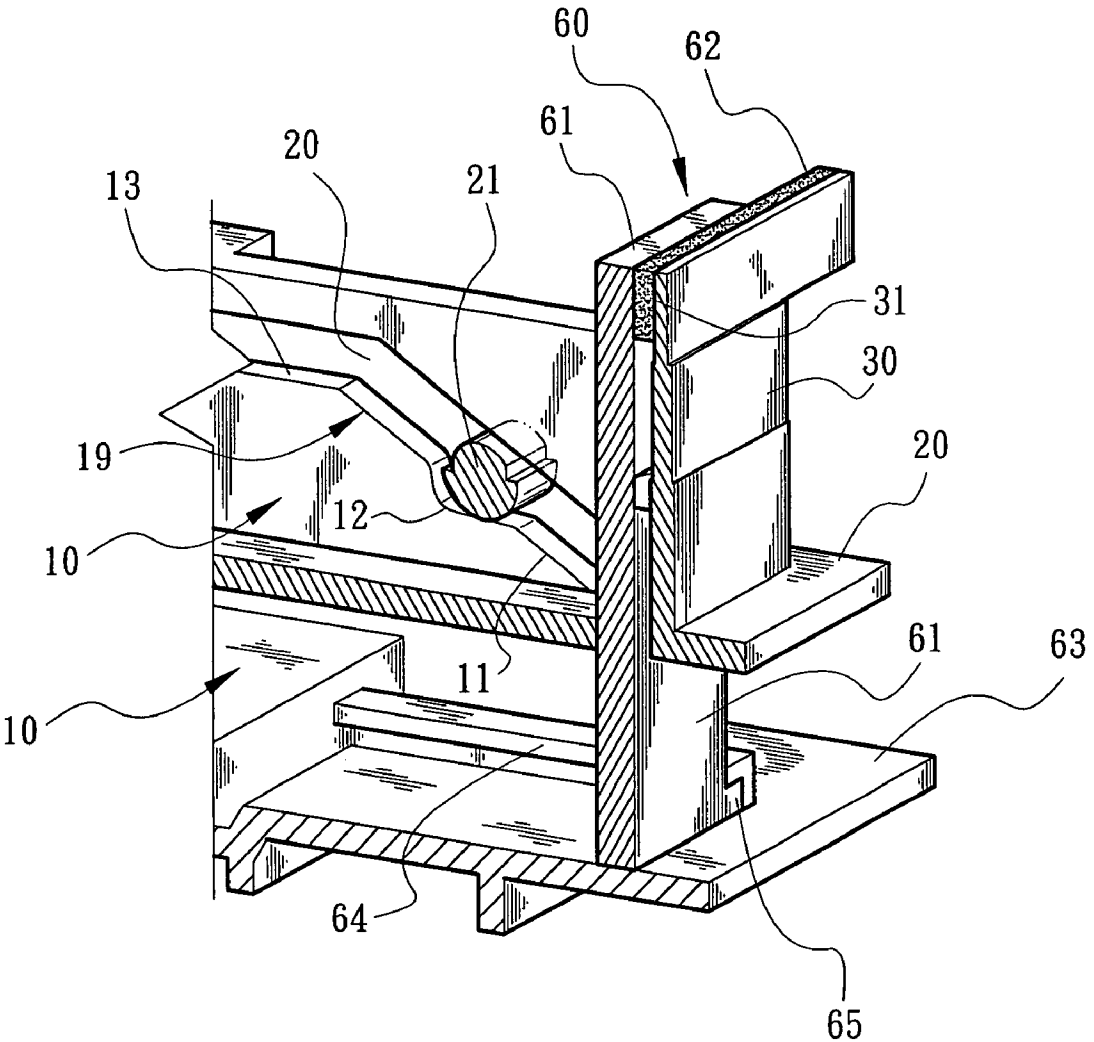
FIG. 2 is a perspective sectional view of the cleaning device for ink wiper of the present invention, showing the structural relationship between the cleaning device, the bracket and the slide rack.
Figure 3:
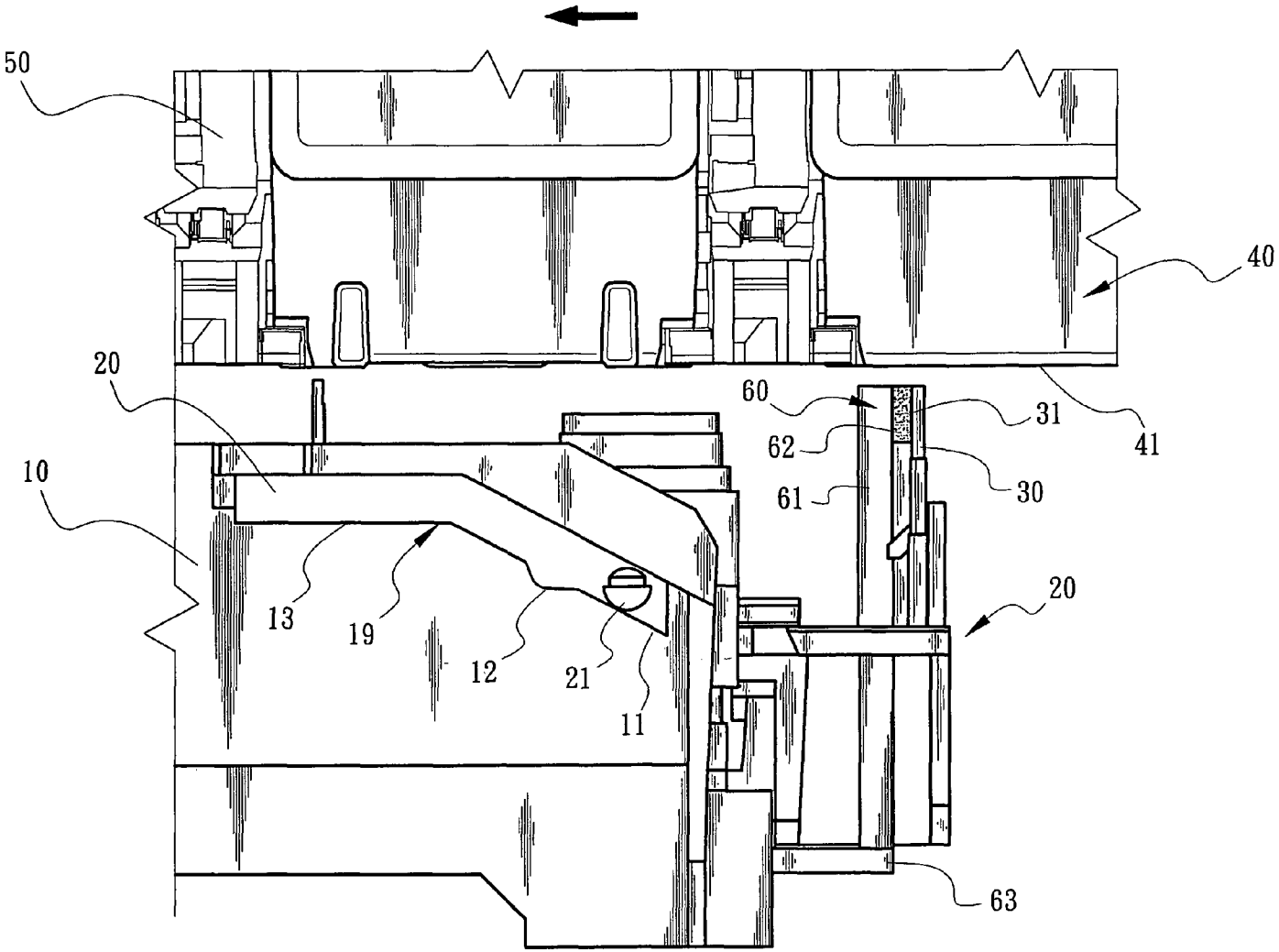
FIG. 3 is a side view of the cleaning device for ink wiper of the present invention, showing the operation thereof, in which the projecting pin of the slide rack is positioned in the first position and the wiper is not lifted.

Please refer to FIGS. 1 and 2. The cleaning device for ink wiper of the present invention includes a bracket 10 and a slide rack 20. The bracket 10 has a rail 19 defining a first position 11, a second position 12 (also defined as a wiping position) and a third position 13 (also defined as a capping position) at different heights. The slide rack 20 has a projecting pin 21 slidably positioned in the rail 19 of the bracket 10 and movable between the first, second and third positions 11, 12, 13. A wiper 30 is mounted on the slide rack 20. When the slide rack 20 is pushed by a main body 50 equipped with a printing head 40 (as shown in FIG. 3), the projecting pin 21 is moved within and along the rail 19. Simultaneously, the slide rack 20 is moved between the first, second and third positions 11, 12, 13. In the meantime, the wiper 30 moves along a horizontal reference axis and descends/ascends along a vertical reference axis as shown by phantom lines in FIG. 1.

Referring to FIG. 2, a cleaning device 60 is arranged in a position adjacent to the wiper 30. The cleaning device 60 includes a stand 61 and an ink-absorbing unit 62 disposed on the stand 61. The ink-absorbing unit 62 is constantly in contact with at least one face 31 of the wiper 30. Preferably, the ink-absorbing unit 62 is positioned at a height equal to or slightly higher than the height of the face 31 of the wiper 30. Preferably, the ink-absorbing unit 62 is made of a spongy material or the like. When the wiper 30 moves along the vertical reference axis, the ink-absorbing unit 62 serves to absorb the ink remaining on the wiper 30 and thus avoid affection of the ink on the ink-wiping effect of the wiper 30. Preferably, the stand 61 and the ink-absorbing unit 62 are replaceable.

Referring to FIG. 2, the stand 61 is arranged on a carrier 63 fixed on the bracket 10. The carrier 63 has a guide channel 64 parallel to the length of the carrier 63. The stand 61 has a leg section 65 slidably fitted in the guide channel 64. Accordingly, the stand 61 and the ink-absorbing unit 62 are reciprocally movable along the guide channel 64 along with the slide rack 20 and the wiper 30.

Referring to FIG. 3, when the projecting pin 21 of the slide rack 20 is positioned in the first position 11 of the rail 19, the wiper 30 is not in contact with the printing head 40. When the main body 50 with the printing head 40 is moved leftward in a direction as shown by the arrow of FIG. 3, the main body 50 will eventually push the slide rack 20 to move the projecting pin 21 along the rail 19 to the second position 12. At the same time, the slide rack 20 is forcedly moved upward to lift the wiper 30 into a position where the wiper 30 interferes with the printing head 40.

Figure 4:
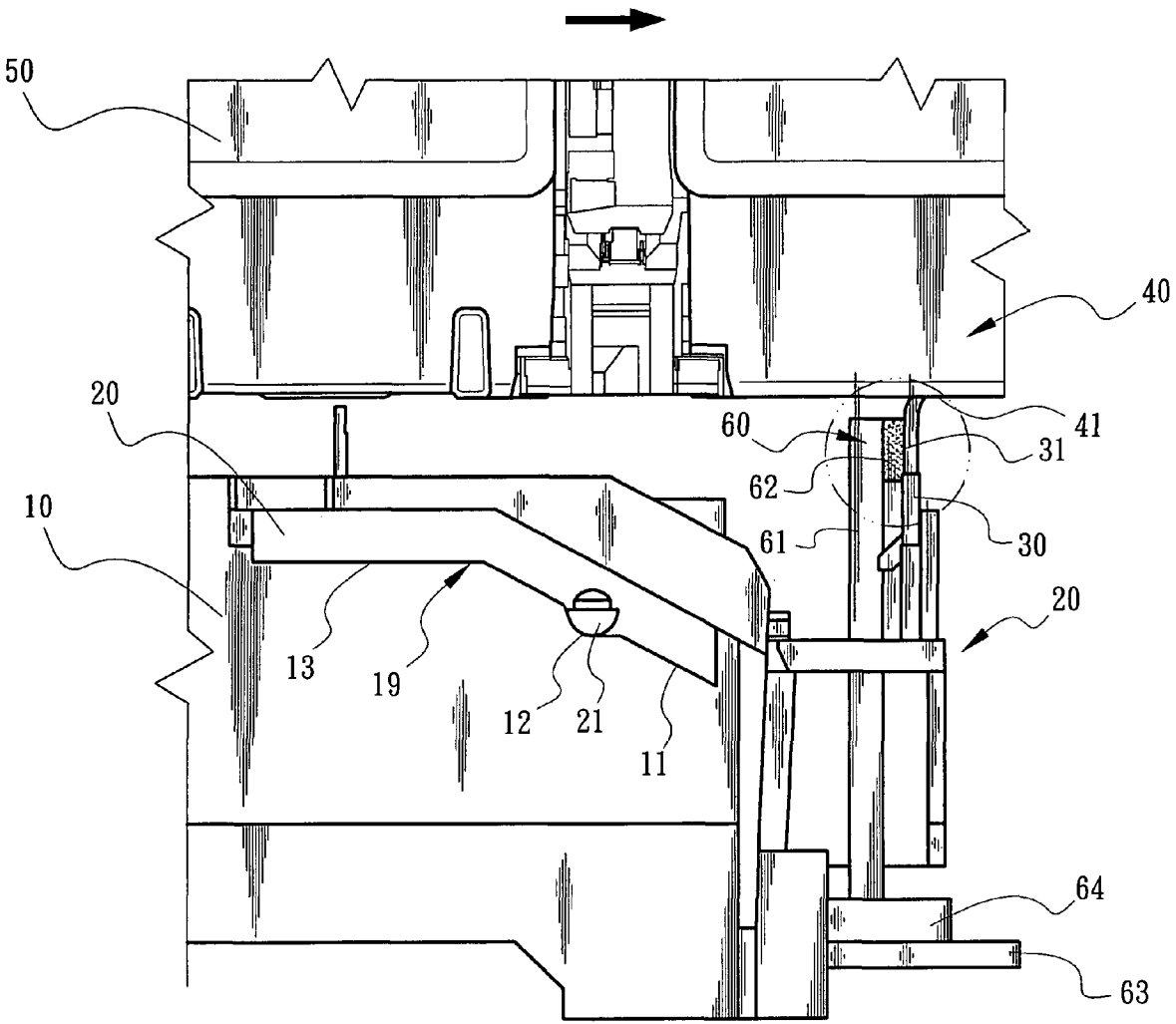
FIG. 4 is a side view according to FIG. 3, in which the projecting pin of the slide rack is positioned in the second position and the wiper is lifted.
Figure 6:
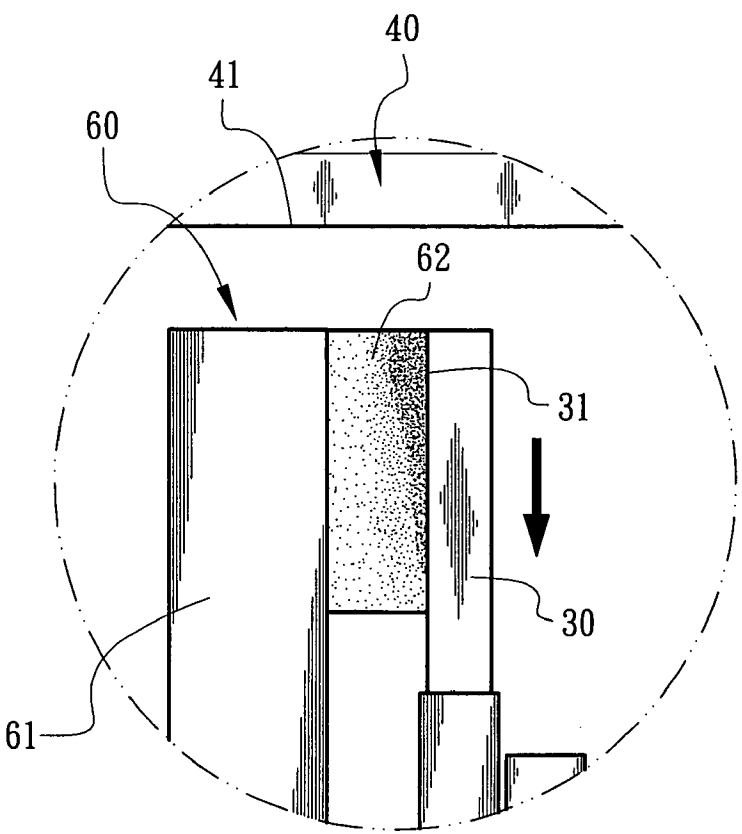
FIG. 6 is an enlarged view of the circled area of FIG. 4, showing that when the projecting pin is moved back into the first position, the wiper is lowered and ink-absorbing unit of the cleaning device cleans off the ink from the wiper.
Figure 5:
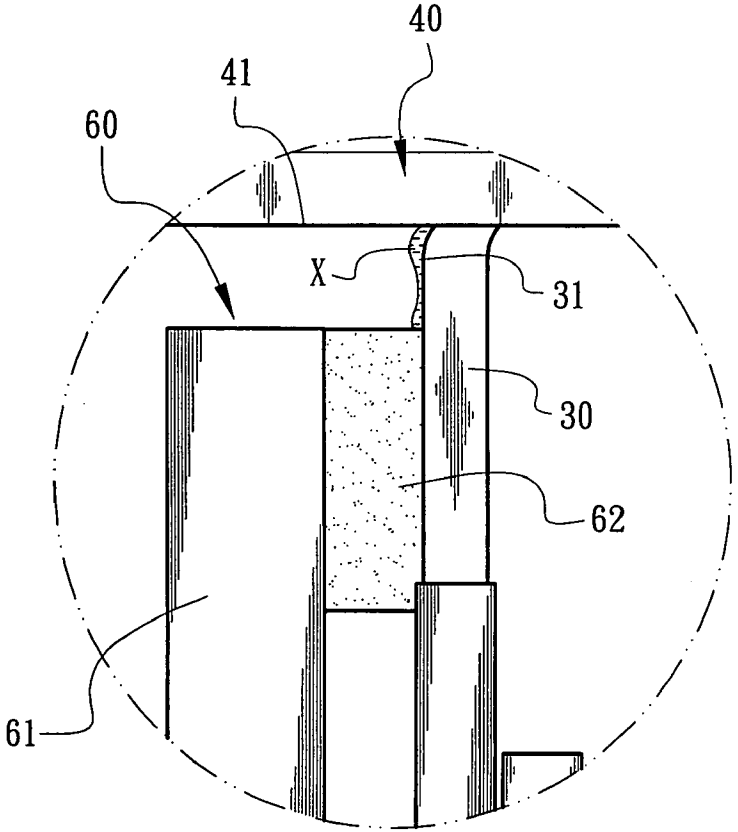
FIG. 5 is an enlarged view of the circled area of FIG. 4, showing that the wiper wipes off the ink from the nozzle of the printing head.

Please refer to FIG. 4. When the main body 50 with the printing head 40 is moved rightward in a direction as shown by the arrow of FIG. 4, the wiper 30 interferes with the printing head 40 and wipes off the ink X stagnating on and around the nozzle 41 as shown in FIG. 5.

When the main body 50 with the printing head 40 is further moved rightward according to FIG. 4, the main body 50 will eventually push the slide rack 20 to move the projecting pin 21 downward along the rail 19 back to the first position 11. When the slide rack 20 is moved downward, the wiper 30 is lowered, whereby the ink-absorbing unit 62 cleans off or absorbs the ink X remaining on the wiper 30. According to the above, the affection of the ink on the ink-wiping effect of the wiper 30 is avoided. Therefore, the printing quality of the printing head 40 can be ensured.

According to the above arrangements, the present invention has the following advantages:

1. The present invention provides a cleaning device 60 which is co-usable with a wiper 30 for cleaning off or absorbing the ink remaining on the wiper 30. By means of the cleaning device 60, the ink is prevented from stagnating on the wiper 30 and solidifying to affect the ink-wiping effect of the wiper 30.
2. When the wiper 30 reciprocally moves, the ink-absorbing unit 62 of the cleaning device 60 simultaneously cleans off or absorbs the ink remaining on the wiper 30. Therefore, no additional driving unit is necessary for driving the cleaning device 30.
3. The stand 61 with the ink-absorbing unit 62 is arranged on a carrier 63 having a guide channel 64. The stand 61 and the ink-absorbing unit 62 are reciprocally movable along the guide channel 64 along with the slide rack 20 and the wiper 30. Therefore, the ink-absorbing unit 62 is constantly in contact with one face 31 of the wiper 30. Under such circumstance, the ink-absorbing unit 62 of the cleaning device 60 can immediately clean off or absorb the ink remaining on the wiper 30 to keep the wiper 30 in a most effective state.

The above embodiments are only used to illustrate the present invention, not intended to limit the scope thereof. Many modifications of the above embodiments can be made without departing from the spirit of the present invention.

What is claimed is:

1. A cleaning device for ink wiper, the cleaning device being arranged in a position adjacent to the wiper which is reciprocally movable, the cleaning device comprising:

a bracket, having a rail;

a slide rack, having a projecting pin slidably positioned and movable in the rail of the bracket;

a stand, arranged on a carrier fixed on the bracket; and an ink-absorbing unit disposed on the stand, in a reciprocation travel of the wiper, the ink-absorbing unit serving to clean off ink drops remaining on the wiper, wherein the carrier has a guide channel, the stand has a leg section slidably fitted in the guide channel, and when the slide rack is pushed by a main body equipped with a printing head to reciprocate, the stand and the ink-absorbing unit reciprocate along the guide channel while the projecting pin moves within and reciprocate along the rail, and the wiper moves vertically relative to the stand and the ink-absorbing unit.

2. The cleaning device for ink wiper as claimed in claim 1, wherein the ink-absorbing unit is constantly in contact with at least one face of the wiper.

3. The cleaning device for ink wiper as claimed in claim 2, wherein the ink-absorbing unit is positioned at a height equal to a height of the face of the wiper.

4. The cleaning device for an ink wiper as claimed in claim 2, wherein the ink-absorbing unit is positioned at a height slightly higher than a height of the face of the wiper.

5. The cleaning device for ink wiper as claimed in claim 1, wherein the ink-absorbing unit is made of a spongy material.

6. The cleaning device for ink wiper as claimed in claim 1, wherein the rail defines a first position, a second position and a third position at different heights.

* * * * *